US008776410B2

(12) United States Patent
Ducruet et al.

(10) Patent No.: US 8,776,410 B2
(45) Date of Patent: Jul. 15, 2014

(54) IRONING BOARD COMPRISING ONE LEG COMPOSED OF TWO PARTS CONNECTED TO ONE ANOTHER BY A JOINT

(71) Applicant: SEB S.A., Ecully (FR)

(72) Inventors: Guy Ducruet, Lyons (FR); Daniel Vieira Gameiro, Leira (PT)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 13/901,029

(22) Filed: May 23, 2013

(65) Prior Publication Data

US 2013/0340301 A1 Dec. 26, 2013

(30) Foreign Application Priority Data

May 24, 2012 (FR) ..... 12 54787

(51) Int. Cl.
*D06F 81/04* (2006.01)
*A47B 3/02* (2006.01)

(52) U.S. Cl.
USPC ..... 38/135; 108/118

(58) Field of Classification Search
USPC ..... 38/103–139; 223/117–119; 108/115–118
See application file for complete search history.

(56) References Cited

U.S. PATENT DOCUMENTS

| | | | | | |
|---|---|---|---|---|---|
| 858,969 | A * | 7/1907 | French | 108/168 |
| 1,115,731 | A * | 11/1914 | Owens | 108/35 |
| 2,651,861 | A | 1/1952 | Wood | |
| 2,603,011 | A * | 7/1952 | Plumb | 108/25 |
| 2,738,604 | A * | 3/1956 | Toth | 108/36 |
| 2,997,799 | A * | 8/1961 | Castucci | 38/139 |
| 3,288,090 | A * | 11/1966 | King | 108/138 |
| 6,014,827 | A * | 1/2000 | Lehrman | 38/104 |
| 7,685,750 | B2 * | 3/2010 | Voitchovsky | 38/103 |
| 8,359,774 | B2 * | 1/2013 | Trowsdale et al. | 38/137 |
| 2003/0000117 | A1 * | 1/2003 | Manfiotto | 38/137 |

FOREIGN PATENT DOCUMENTS

| | | |
|---|---|---|
| EP | 1848852 A1 | 10/2007 |
| GB | 449441 A | 6/1936 |

* cited by examiner

*Primary Examiner* — Ismael Izaguirre
(74) *Attorney, Agent, or Firm* — The Webb Law Firm

(57) ABSTRACT

Ironing board consisting of a top supported by at least one leg with two sections connected to one another by hinge; said hinge allows lower segment of leg to pivot between an unfolded position, in which said lower segment forms an extension of upper segment of leg, and a folded position, in which lower segment is folded in the direction of upper segment, wherein said hinge contains a mechanism to lock the lower segment in an unfolded position and at least one unlocking button to deactivate the locking mechanism to allow lower segment to rotate into the folded position.

14 Claims, 6 Drawing Sheets

IRONING BOARD COMPRISING ONE LEG COMPOSED OF TWO PARTS CONNECTED TO ONE ANOTHER BY A JOINT

BACKGROUND OF THE INVENTION

1. Field of the Invention

This invention relates to an ironing board containing a top supported by at least one leg with two sections hinged to one another and, more particularly, relates to an ironing board in which a hinge allows the lower leg segment to pivot between an unfolded position, in which the lower segment forms an extension of the upper leg segment, and a folded position, in which the lower segment is folded in the direction of the upper segment.

2. Prior Art

European patent filing no. 1 848 852 discloses an ironing board that has a top supported by two legs arranged in the shape of an x, where one of the legs includes two sections hinged to one another to allow the lower leg segment to pivot between an unfolded position, in which the lower segment forms an extension of the upper leg segment, and a folded position, in which the lower segment is folded in the direction of the upper segment.

In that document, the hinge is equipped with a recall mechanism to hold the lower segment in a folded or unfolded position to eliminate any movement thereof when the ironing board is used in an open or closed position.

However, such a hinge has a disadvantage in that it results in abrupt leg movements when the recall mechanisms is activated, which may injure the user, in particular, by pinching the user's fingers when the leg is folded.

UK patent GB 449 441 discloses an ironing board with a top supported by one leg with two sections hinged to one another to allow the lower leg segment to pivot between an unfolded and folded position; the hinge contains a locking mechanism to lock the lower segment in an unfolded position and a unlocking button to deactivate the locking mechanism.

However, such an ironing board has the disadvantage of not being ergonomic to use in that it is difficult to unlock the leg since the locking button is not always visible to the user due to its position on the ironing board.

Also, an object of this invention is to remedy these disadvantages by proposing an ironing board equipped with legs that have an improved hinge that provides greater ease of use. Another object of this invention is to provide an ironing board that is simple and economic to implement.

SUMMARY OF THE INVENTION

To this end, the object of the invention is an ironing board with a top supported by at least one leg with two sections hinged to one another to allow the lower leg segment to pivot between an unfolded position, in which the lower segment forms an extension of the upper leg segment, and a folded position, in which the lower segment is folded in the direction of the upper segment, where the hinge contains a mechanism to lock the lower segment in the unfolded position and at least one unlocking button to deactivate the locking mechanism to allow the rotation of the lower segment into the folded position.

According to another characteristic of the invention, the hinge contains at least two unlocking buttons conveniently located on the two opposing faces of the hinge.

Such a characteristic has the advantage of providing improved ergonomics of use as the unlocking buttons are easier to see.

According to another characteristic of the invention, the lower segment extends at the same time as the upper segment when in the folded position.

According to another characteristic of the invention, the upper and lower segments are connected by a rotation axis placed on the outside of the leg.

According to another characteristic of the invention, the hinge contains a first button that is mounted to pivot around an axis provided by the hinge that is part of the upper segment; this button shifts between a rest position, in which the button contains an end equipped with a hook that works with a blocking device mounted on the second section of the hinge attached to the lower segment to immobilize the second section in the unfolded position, and a working position, in which the first button is pivoted so that the hook is disengaged from the block stop.

According to another characteristic of the invention, the first button is shifted to the rest position by a recall mechanism.

According to another characteristic of the invention, the hinge contains a second mobile button in an orifice located under the hook; this button shifts between a rest position, in which the hook may be engaged behind the block stop, and an activated position, in which the second unlocking button pushes the hook outside the block stop.

According to yet another characteristic of the invention, the top is supported by a frame connected to the two legs that are connected to one another by a pivot connection at an intermediate point along their length. The legs may be moved between a storage position, in which the legs are placed essentially parallel to the top, and a working position, in which the legs are placed in the shape of an x, where one of the legs, called the first leg, is divided into two sections connected to one another by the hinge, and the other leg, called the second leg, is used only for support.

According to another characteristic of the invention, the upper segment of the first leg includes the pivot connection with the second leg. The lower segment of the first leg can be rotated between unfolded and folded positions, and reciprocally, when the first and second legs are in the storage position.

According to yet another characteristic of the invention, the first leg contains an upper end mounted to pivot near an end of the frame.

According to yet another characteristic of the invention, the top contains a main section mounted to slide on the frame and at least one folding rear section connected to the main section with hinges; the folding rear section shifts between a working position, in which the folding rear section is placed along the main section, and a storage position, in which the folding rear section is pulled down to the main section.

According to yet another characteristic of the invention, the frame has a mobile iron stand that shifts on the frame between a working position, in which the iron stand is placed next to the folding rear section of the top, and a storage position, in which the folding rear section and the main section of the top are at least partially located under or on the iron stand.

According to yet another characteristic of the invention, the second leg includes an upper end that pivots and slides on the frame.

According to yet another characteristic of the invention, the first and second leg contain a lower end with a cross bar extending diagonally across the top.

According to yet another characteristic of the invention, the ironing board contains a platform mounted on a framework formed by a longitudinally mounted end that pivots around an axis mounted on the upper segment of the first leg, between the pivot connection and the hinge.

BRIEF DESCRIPTION OF THE DRAWINGS

The objectives, aspects and advantages of this invention will be better understood from the following description of one specific embodiment of the invention, which is presented as a non-limiting example by referring to the attached drawings, in which.

DETAILED DESCRIPTION OF THE INVENTION

Only the items necessary to understand the invention have been shown. For ease of reading the drawings, the same items are labeled in the same way on all drawings.

Figure 1:
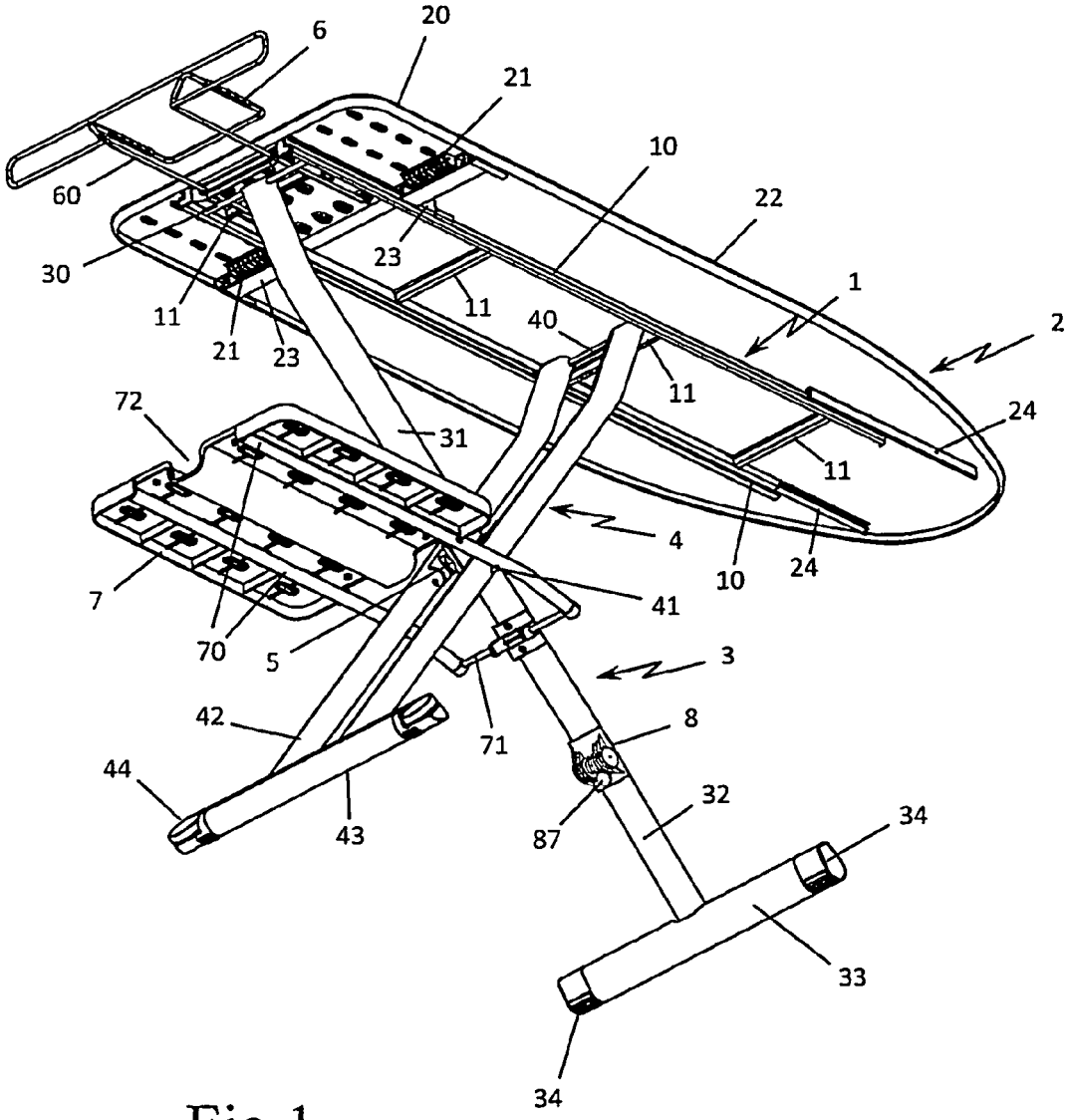
FIG. 1 is a perspective view from below of an ironing board based on the specific embodiment of the invention where the ironing board is shown with the top and iron stand in working position.
Figure 2:
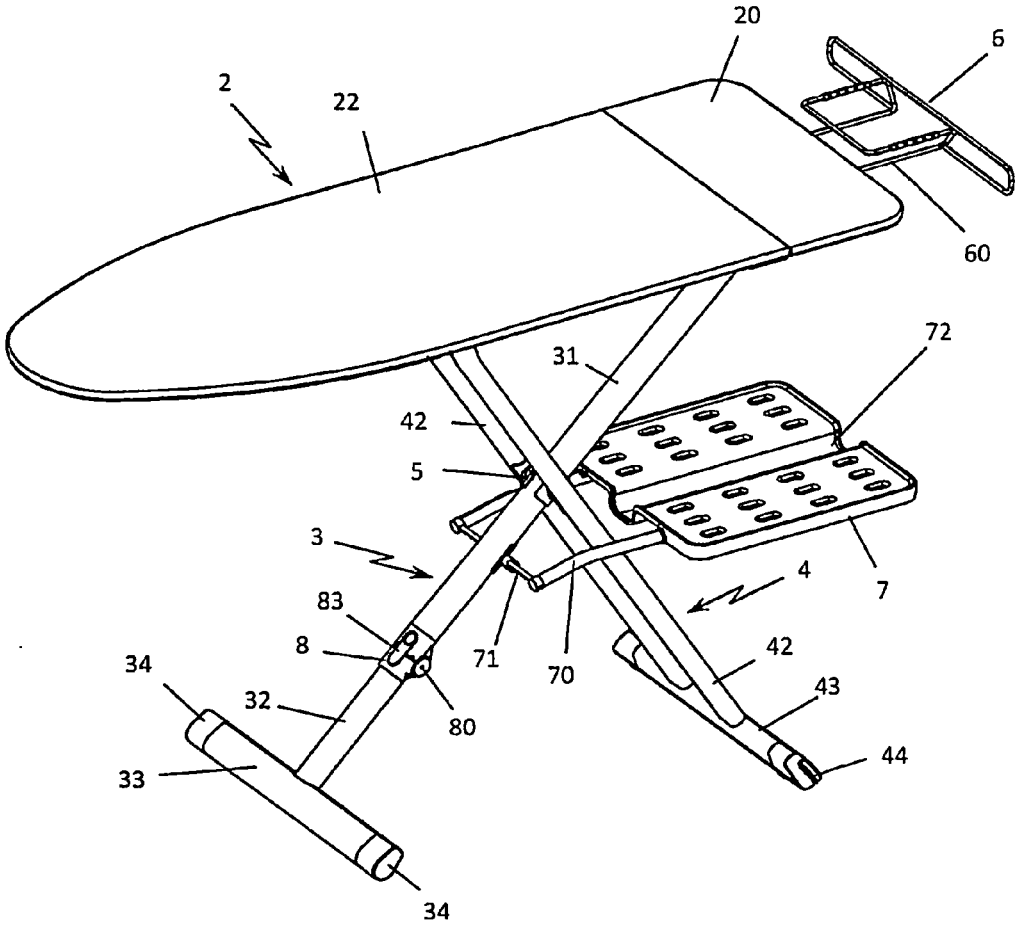
FIG. 2 is a perspective view from above of the ironing board illustrated in FIG. 1.

FIGS. 1 and 2 show an ironing board with frame 1 supporting top 2 the width of which decreases closer to its rounded front end; frame 1 is supported by two rigid legs 3, 4 arranged in the shape of an X, with the two legs 3, 4 connected to one another by pivot connection 5 located at an intermediate point along their length.

Frame 1 contains two bars 10, approximately 100 cm in length, preferably made of streamlined extruded aluminum, connected by four traverses 11; one of the legs, called first leg 3, has an upper integrated end, rod 30, mounted to pivot near a rear end of frame 1; the other leg, called second leg 4, has an upper integrated end, rod 40, mounted to sliding within guiding rails placed on the internal lateral face of bars 10. The longitudinal positioning of rod 40 along bars 10 and, as a result, the height of top 2 of the ironing board, are controlled in a known manner using a blocking mechanism not shown on the drawings.

Figure 3:
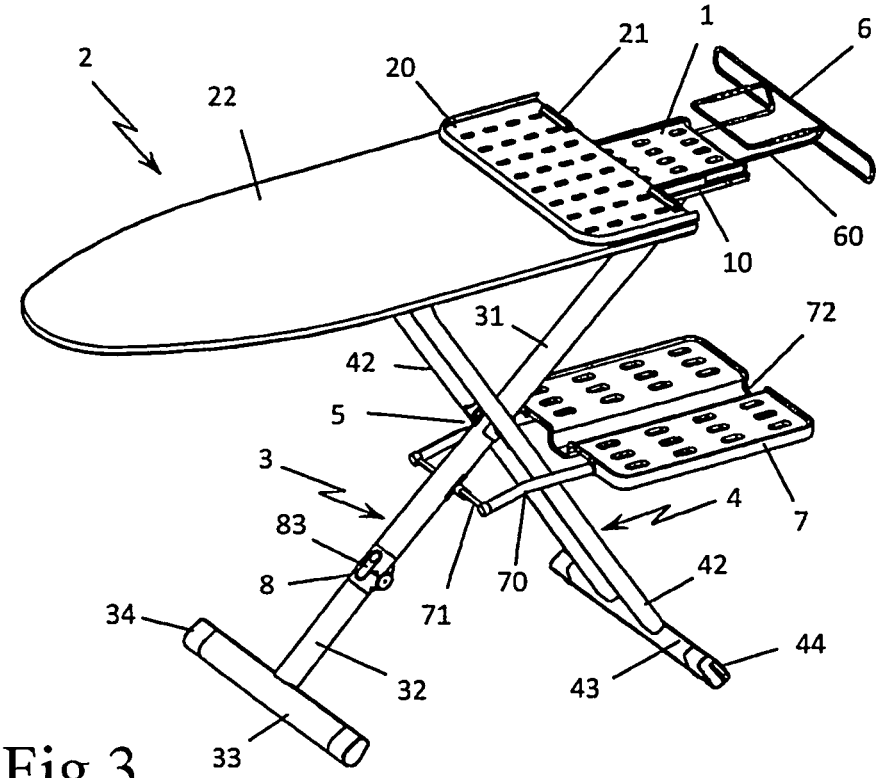
FIG. 3 is a perspective view, similar to FIG. 1, showing the ironing board with the top folded for storage.
Figure 4:
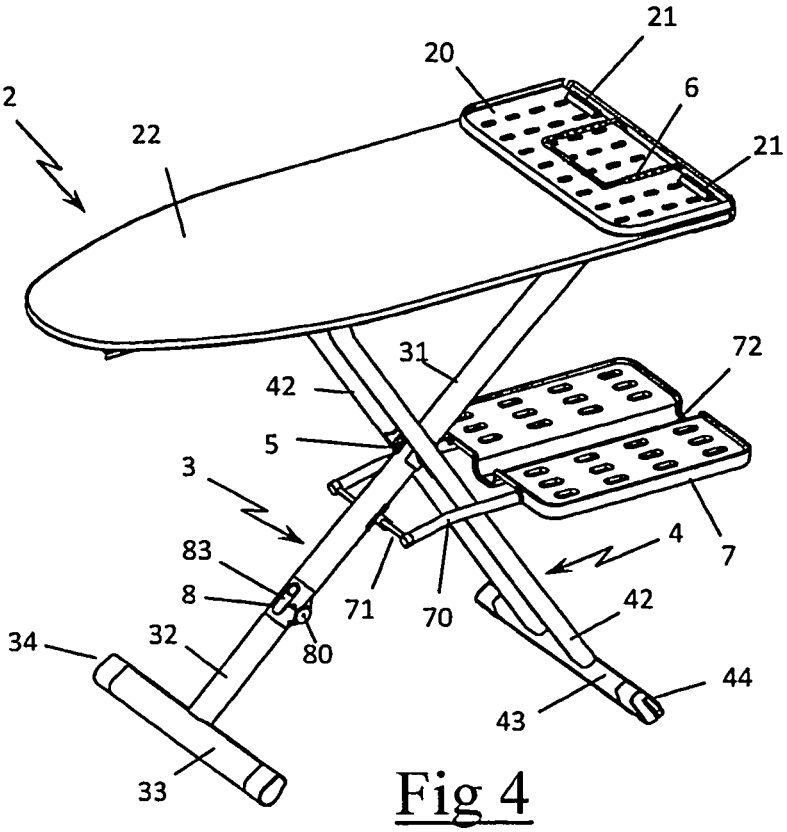
FIG. 4 is a perspective view, similar to FIG. 1, showing the ironing board with the top and the stand folded for storage.
Figure 5:
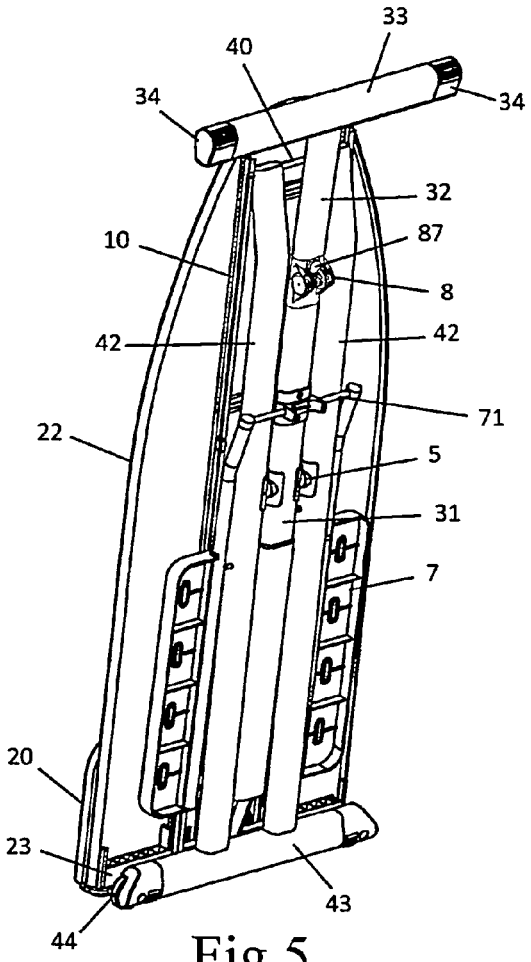
FIGS. 5 and 6 are perspective views of the ironing board with the top, iron stand and legs folded for storage, the lower segment of the first leg being is shown in the unfolded and folded positions, respectively.
Figure 6:
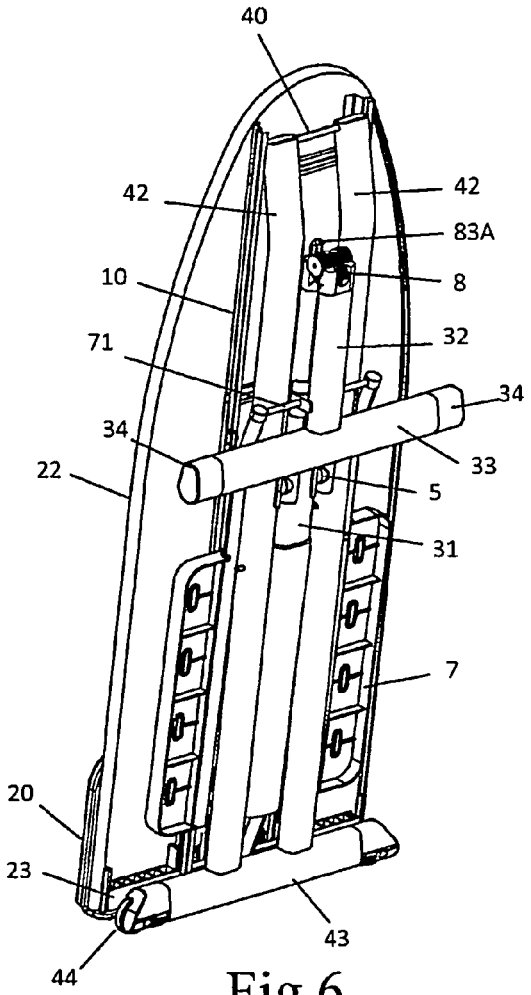

Thus connected to frame 1, legs 3, 4 shift between the working position shown in FIGS. 1 to 4, in which legs 3, 4 are arranged in the shape of an X, and the storage position shown in FIGS. 5 and 6, in which legs 3, 4 are placed essentially parallel to top 2.

According to FIG. 3, top 2 preferably contains rear folding section 20, approximately 20 cm in length, connected by double-axis hinges 21 to main section 22, which is approximately 110 cm in length; top 2 is approximately 45 cm in width along three-quarters of its length from its rear end.

Rear folding section 20 of the top thus created may be in a working position, shown in FIGS. 1 and 2, in which rear section 20 rests on bars 10 and is located along main section 22 of top 2 to create therewith a continuous top for ironing; rear section 20 may also be in a storage position in which it is pulled down against main section 22 of top 2, as shown in FIGS. 3 and 4.

As can be seen in FIG. 1, main section 22 of top 2 is attached, near its rear end, to carriage 23 and, near its front end to two longitudinal guide stops 24; carriage 23 and guide stops 24 are mounted to slide along rails on the outside face of bars 10 so that top 2 may be moved along frame 1 between a working position, shown in FIGS. 1 and 3, in which the rear end of main section 22 of top 2 is moved 20 cm compared to the rear end of frame 1, and a storage position shown in FIGS. 4 to 6, in which the rear end of main section 22 of the top is located at the same height as the rear end of frame 1; carriage 23 has a brake mechanism, which is not shown in the drawings, to immobilize top 2 in the desired position.

Preferably, the ironing board also contains iron stand 6 placed along top 2 and platform 7 placed under top 2 to hold clothes or a steam-generation base.

Iron stand 6 is preferably made from folded metal wire and is supported by two arms 60 mounted to slide on the rear end of frame 1; iron stand 6 can shift between a working position, shown in FIG. 2, in which iron stand 6 is located cantilevered outside frame 1 and side by side with top 2, and a storage position, shown in FIG. 4, in which iron stand 6 is shifted to above top 2 folded for storage, with iron stand 6 slightly raised above top 2 so that the rear end of main section 22 of the top, and rear section 20 in folded position, can be moved under iron stand 6 as shown in FIG. 4.

Platform 7 is preferably made of a plastic material and is mounted on a framework consisting of two longitudinal tubes 70 the extremities of which are hinged to one another by transversal tube 71 mounted to pivot on first leg 3, slightly below pivot connection 5 connecting the two legs 3, 4; second leg 4 contain rollers 41 on which longitudinal tubes 70 are mounted to hold platform 7 in a horizontal position when legs 3, 4 are deployed in working position. When legs 3, 4 are folded for storage, platform 7 pivots around tube 71 and becomes parallel to top 2; platform 7 contains longitudinal gutter 72 that creates a housing for first leg 3, as shown in FIGS. 5 and 6.

First leg 3 consists of two sections and contains upper segment 31 and lower segment 32 connected to one another by hinge 8 to allow lower segment 32 to pivot between an unfolded position, shown in FIG. 5, in which lower segment 32 is aligned with upper segment 31 of the leg, and a folded position, shown in FIG. 6, in which lower segment 32 is folded against upper segment 31, essentially parallel with it.

Preferably, upper segment 31 of first leg 3 is made from a rectilinear tube, approximately 85 cm in length, with a slight elbow approximately 10 centimeters from its upper end, and lower segment 32 is made from a rectilinear tube, approximately 20 cm in length; the lower end of lower segment 32 contains cross bar 33 approximately 45 cm in length equipped with anti-skid runner 34 on each end.

Second leg 4 is the only weight-bearing leg and is preferably made from two essentially parallel rectilinear tubes 42, approximately 105 cm in length; the two tubes are connected at their upper end to rod 40 mounted to slide on frame 1 and are connected at their lower end to cross bar 43, approximately 45 cm in length with, at each end, caster 44 oriented longitudinally to cross bar 43.

According to FIGS. 7 to 12, hinge 8 connects upper segment 31 to lower segment 32 of the first leg with axis of rotation 80 connecting first section 81 of the hinge that fits into the tube of upper segment 31 to second section 82 of the hinge that fits into the tube of lower segment 32; axis of rotation 80 is perpendicular to first leg 3 and is located on the outside of first leg 3 so that lower segment 32 can be folded against upper segment 31 by rotating 180°.

More specifically, according to the invention, hinge 8 contains a locking mechanism to lock lower segment 32 in unfolded position that consist of unlocking button 83 to deactivate the locking mechanism.

Figure 7:
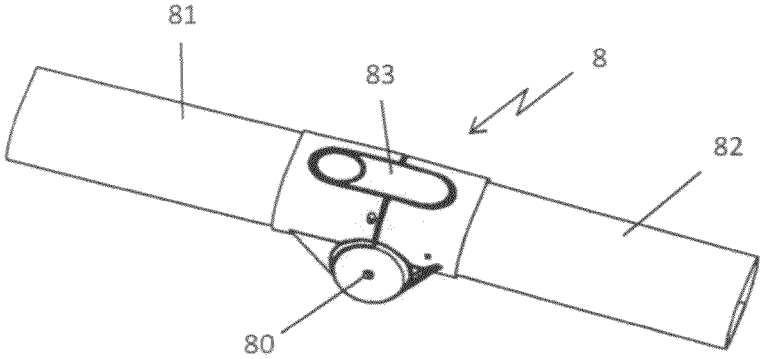
FIGS. 7 and 8 are detailed views, in perspective, of the hinge of the first leg of the ironing board in unfolded position.
Figure 8:
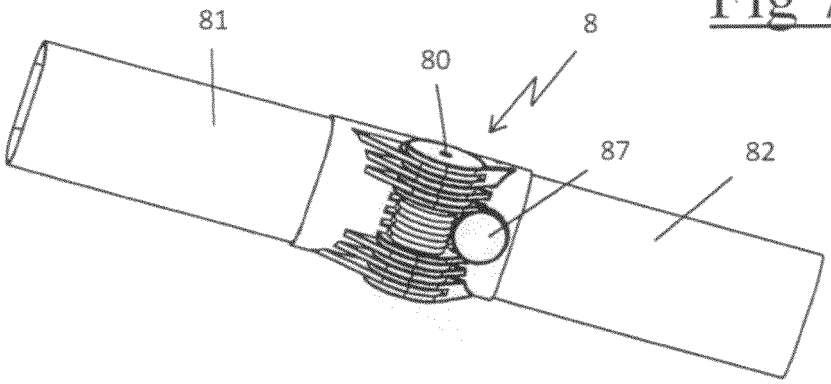

Locking button 83 is preferably located on the upper face of leg 3, which is shown in FIG. 7, and hinge 8 preferably contains second unlocking button 87 on the opposite face of first leg 3, shown in FIG. 8.

Figure 10:
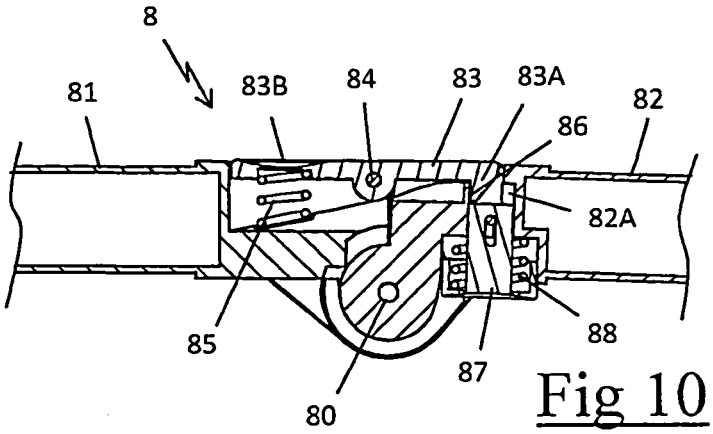
FIG. 10 is a cutaway view of the hinge in FIG. 8 without any unlocking buttons pressed.
Figure 11:
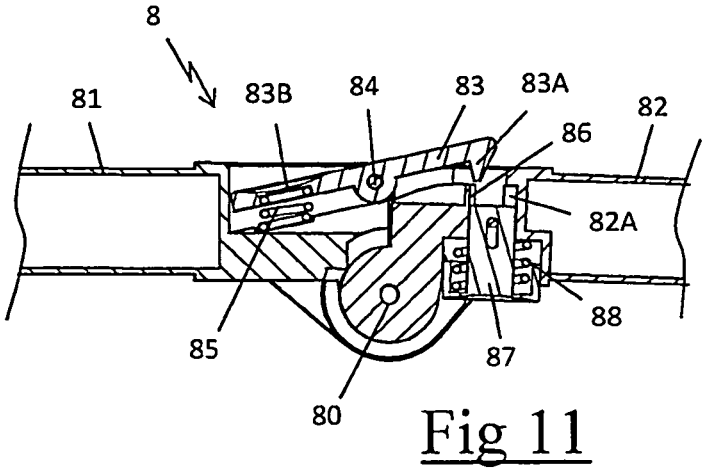
FIGS. 11 and 12 are cutaway views of the hinge in FIG. 8 when the first and second unlocking buttons, respectively, are pressed.
Figure 12:
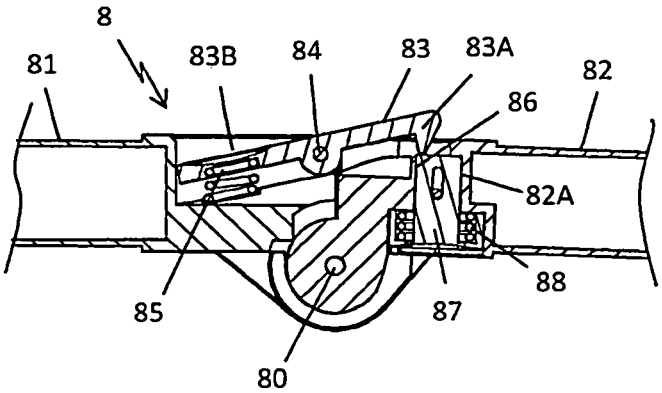

According to FIGS. 10 to 12, first unlocking button 83 is mounted to pivot around axis 84 on first section 81 of the hinge near the face of hinge 8 opposite to the face that accepts axis of rotation 80; first unlocking button 83 contains an end with hook 83A and an opposite end with trigger zone 83B, in the form of a reinforcement on the top of first button 83, which can shift between a rest position shown in FIG. 10, to which it is returned by recall spring 85, and a working position to which it is moved when the user pressures on trigger zone 83B, as shown in FIG. 11.

When first unlocking button 83 is in rest position, hook 83A engages behind blocking device 86 mounted on the second section 82 of the hinge, as shown in FIG. 10; block stop 86 extends on a plane perpendicular to the longitudinal axis of second section 82 so that hook 83A engages behind block stop 86 locking hinge 8 in the unfolded position.

Figure 9:
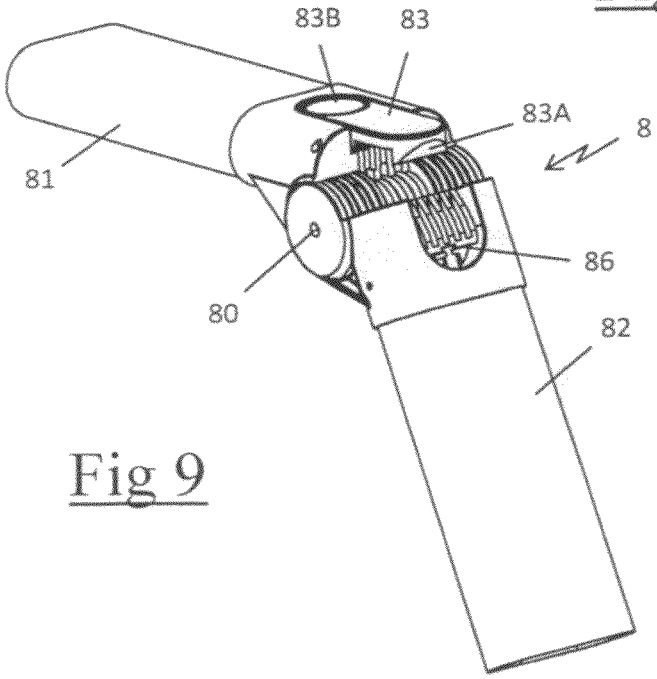
FIG. 9 is a perspective view of the hinge in FIG. 8 in an intermediate folding phase.

Conversely, when first unlocking button 83 is in the activated position, hook 83A is rotated to the outside of hinge 8 and disengages from block stop 86 so that second section 82 of the hinge may shift around axis of rotation 80 as shown in FIG. 9.

Second unlocking button 87 can shift through orifice 82A installed in second section 82 of the hinge to under hook 83A of first unlocking button 83; second unlocking button 87 can shift between a rest position, shown in FIG. 10, to which it is returned by recall spring 88, and an activated position to which it is moved when the user presses on second unlocking button 87, as shown in FIG. 12.

According to FIG. 10, when second unlocking button 87 is in the rest position, it is withdrawn into orifice 82A, which allows hook 83A to be engaged behind block stop 86. Conversely, when second unlocking button 87 is in the activated position, it is moved forward to an advanced position in which an end of second unlocking button 87 pushes hook 83A outside orifice 82A so that hook 83A disengages from block stop 86, which allows hinge 8 to rotate freely.

The ironing board realized in this manner has the advantage of greater safety during use as the ironing board, in working position, can be moved without risk of unforeseen rotation of the lower segment into the folded position.

This ironing board also has the advantage of better ergonomics in use, as the legs of the ironing board can be folded into the storage position and the lower segment rotated to the folded position in any sequence. In particular, the lower segment can be rotated to the folded position either when the ironing board is rotated on its second leg and when the two legs are again placed in working position, but also very easily when the two legs are folded for storage by pressing on the first or second button, with reduced risk of fingers being pinched.

Further, the lower segment can be shifted into the folded position, shown in FIG. 6, resulting in an extremely compact ironing board in which the legs of the ironing board remain within the main section of the top without protruding outside the top.

Once in this storage position, the ironing board may be easily moved by rotating it slightly so that it rests only on the casters of the second leg.

The ironing board also has the advantage of a top with a large ironing area that is very stable once unfolded into working position due to the significant contact area between the first and second legs, due, in particular, to the length of the first leg and the presence of large traverses that provide the ironing board with excellent lateral stability.

Of course, the invention is not in any way limited to the completion mode described and illustrated, which is only provided as an example. Other modifications are possible, in particular, by adding other items or by replacement with technical equivalents, without, however, falling outside the scope of protection of the invention.

Accordingly, in a different implementation of the invention not shown, the top of the ironing board may consist of a single section and be immovable relative to the frame.

The invention claimed is:

1. An ironing board comprising a top supported by at least one leg with a lower segment hinged to an upper segment through a hinge; said hinge, which is positioned between the upper segment and the lower segment, allows lower segment of leg to pivot between an unfolded position, in which said lower segment forms an extension of upper segment of leg, and a folded position, in which lower segment is folded in the direction of upper segment and the hinge contains a locking mechanism to lock the lower segment in an unfolded position wherein said hinge contains at least two unlocking buttons conveniently placed on the two opposing faces of hinge, allowing the locking mechanism to be deactivated to allow lower segment to be rotated into the folded position.

2. The ironing board based on claim 1, wherein lower segment extends parallel to upper segment when in the folded position.

3. The ironing board based on claim 2, wherein upper segment and lower segment are connected by axis of rotation located on the outside of leg.

4. The ironing board based on claim 1, wherein the hinge contains first button mounted to pivot around axis located on first section of the integrated hinge of upper segment; said first button can shift between a rest position, in which first button contains an end with hook that works with blocking device located on second section of the integrated hinge of lower segment to immobilize second section in the unfolded position, and a working position in which first button is pivoted so that hook is disengaged from block stop.

5. The ironing board based on claim 4, wherein first button is shifted into the rest position by recall mechanism.

6. The ironing board based on claim 4, wherein hinge contains mobile second button that shifts from orifice under hook; said second button can shift between a rest position, in which hook may be engaged behind block stop, and an activated position, in which second unlocking button pushes hook outside of block stop.

7. The ironing board based on claim 1, wherein top is supported by a frame connected to two legs connected to one another by pivot connection at an intermediary point along their length; said legs is movable between a storage position in which legs are essentially parallel to top and a working position in which legs are arranged in the shape of an x, where one of the legs, so-called first leg, is divided into two sections hinged to one another by said hinge, and the other leg, so-called second leg, is only a supporting leg.

8. The ironing board based on claim 7, wherein upper segment of the first leg supports pivot connection that connects with second leg and wherein lower segment of first leg may be shifted from the unfolded position to the folded position, and, reciprocally, when first and second legs are in the storage position.

9. The ironing board based on claim 7, wherein first leg contains an upper end mounted to pivot near an end of frame.

10. The ironing board based on claim 7, wherein top contains main section mounted to slide on frame and at least one folding rear section connected to main section by hinges; said folding rear section can shift between a working position, in which folding rear section is placed along main section, and a storage position, in which folding rear section is pulled down to main section.

11. The ironing board based on claim 10, wherein said frame holds mobile iron stand on the frame between a working position in which iron stand is located near folding rear section of top in working position and a storage position in which folding rear section and main section of the top are arranged at least partially under or on iron stand.

12. The ironing board based on claim 7, wherein second leg includes an upper end that is mounted to pivot and slide on frame.

13. The ironing board based on claim 1, wherein first leg and second leg have a lower end with cross bar that extends diagonally across top.

14. The ironing board based on claim 1, which contains platform on framework that includes a longitudinal end mounted to pivot around an axis located on upper segment of first leg, between pivot connection and hinge.

* * * * *